US011491366B2

(12) United States Patent
Mittig

(10) Patent No.: US 11,491,366 B2
(45) Date of Patent: Nov. 8, 2022

(54) STABILIZED EXERCISE DEVICE

(71) Applicant: Maelis Mittig, Laurel, MD (US)

(72) Inventor: Maelis Mittig, Laurel, MD (US)

( * ) Notice: Subject to any disclaimer, the term of this patent is extended or adjusted under 35 U.S.C. 154(b) by 0 days.

(21) Appl. No.: 16/852,348

(22) Filed: Apr. 17, 2020

(65) Prior Publication Data

US 2021/0322821 A1 Oct. 21, 2021

(51) Int. Cl.
*A63B 22/16* (2006.01)
*A63B 26/00* (2006.01)

(52) U.S. Cl.
CPC ..... *A63B 22/16* (2013.01); *A63B 26/003* (2013.01)

(58) Field of Classification Search
CPC ..... A63B 22/16; A63B 26/003; A63B 69/20–325; A63B 37/00–43/06; A63B 39/00–08; A63B 37/0022–00221; A63B 41/00–125; A63H 33/04; A63H 33/06; A63H 33/08; A63H 33/086
See application file for complete search history.

(56) References Cited

U.S. PATENT DOCUMENTS

| | | | | |
|---|---|---|---|---|
| 3,185,476 | A * | 5/1965 | Fechner | A63B 43/02 473/596 |
| 7,585,262 | B1 * | 9/2009 | Vayntraub | A63B 23/12 482/141 |
| 8,382,647 | B1 * | 2/2013 | Hodes | A63B 21/075 482/108 |
| 8,454,485 | B1 * | 6/2013 | Hodes | A63B 21/072 482/141 |
| 10,010,470 | B2 * | 7/2018 | Bradford | A63B 23/1209 |
| 10,569,120 | B2 * | 2/2020 | Sorin | A63B 21/4035 |
| 2004/0220022 | A1 * | 11/2004 | McCreath | A63B 69/26 482/83 |
| 2011/0021297 | A1 * | 1/2011 | McCarthy | A63B 39/00 264/328.2 |
| 2013/0274076 | A1 * | 10/2013 | Smith | A63B 21/065 482/105 |
| 2019/0269981 | A1 * | 9/2019 | Jordan | A63B 21/028 |

* cited by examiner

*Primary Examiner* — Joshua Lee
*Assistant Examiner* — Catrina A Letterman
(74) *Attorney, Agent, or Firm* — Mertzlufft Law PLLC

(57) ABSTRACT

The present invention is an exercise device comprising a substantially spherical member having a substantially flat portion, wherein a cavity is accessible from the substantially flat portion through a recess, wherein a lip is formed between the recess and the cavity.

15 Claims, 3 Drawing Sheets

STABILIZED EXERCISE DEVICE

BACKGROUND OF THE INVENTION

The present invention relates to an exercise ball, and more particularly to a stackable exercise ball that provides a cavity to permit the ability to perform additional exercises.

Over the years those engaging in physical fitness exercises have used a variety of different ways to achieve their desired exercise goals. For example, individuals exercise by carrying out routines using their own weight for resistance, such as push-ups and sit-ups. To meet their exercise needs, exercisers have also used hand weights and/or devices that use a system of cables, pulleys, weights, springs, and/or resilient bands.

Recently, however, those engaging in physical fitness activities have recognized the value of exercise devices that place the user in an unstable position. One such device is a stability ball, also known as an exercise ball or a yoga ball.

The stability ball is a large flexible ball that is used to create instability during an exercise routine. As the unstable user exercises, he or she exercises his or her core muscles to maintain balance during the exercise routine. For instance, an exerciser can lie on the stability ball while exercising with hand weights. The instability of the ball requires the user to flex and exert core body muscles to maintain balance while performing the hand weight exercise. Instead of simply exercising a targeted group of muscles, the exerciser on a stability ball also uses core or stabilizing muscles, particularly those in the abdominal region. Stability balls are known to develop balance and stability by exercising the core body muscles.

One problem with stability balls, is certain exercises or persons performing exercise or work out routines that do not benefit or require the instability of ball are limited in their options for a piece of equipment to use. For example, a stability ball that is instable with respect to the support surface tends to roll out of position unless the user is continuously in contact with it. A user can become occupied with maintaining the position of the ball, thus detracting from the core body training experience. Additionally, due to the spherical shape of the stability balls, there is no portion or area which is more convenient to grab or hold onto to perform certain exercises. however, is that stability balls have a tendency to move or roll relative to an underlying support surface. Yet another issue is the storage of these stability balls, as special racks need to be made or large portions of the facility are taken up by these balls wasting precious space.

Thus, it is desired for a redesign stability ball that provides the spherical shape but remaining in a single position, a portion designed to grab on to, and the ability to stack the balls.

SUMMARY

Accordingly, it is an objective of the present invention to provide for an exercise device that is provides both stability through a flattened portion but also the instability when used on the spherical portion, is stackable based on a recessed portion and an internal cavity, and the ability to firmly grasp the device to perform specific exercises.

In a first embodiment, the present invention is an exercise device comprising: a substantially spherical member having a substantially flat portion, wherein a cavity is accessible from the substantially flat portion through a recess, wherein a lip is formed between the recess and the cavity.

In a second embodiment, the present invention is an exercise device comprising: a substantially spherical member, wherein a portion of the spherical member is substantially flat with a first angled sidewall permitting access to an internal cavity with a second angled sidewall, wherein a lip is formed at the junction of the first angled sidewall and the second angled sidewall and the lip has a predetermined contour.

DETAILED DESCRIPTION OF THE INVENTION

Figure 1:
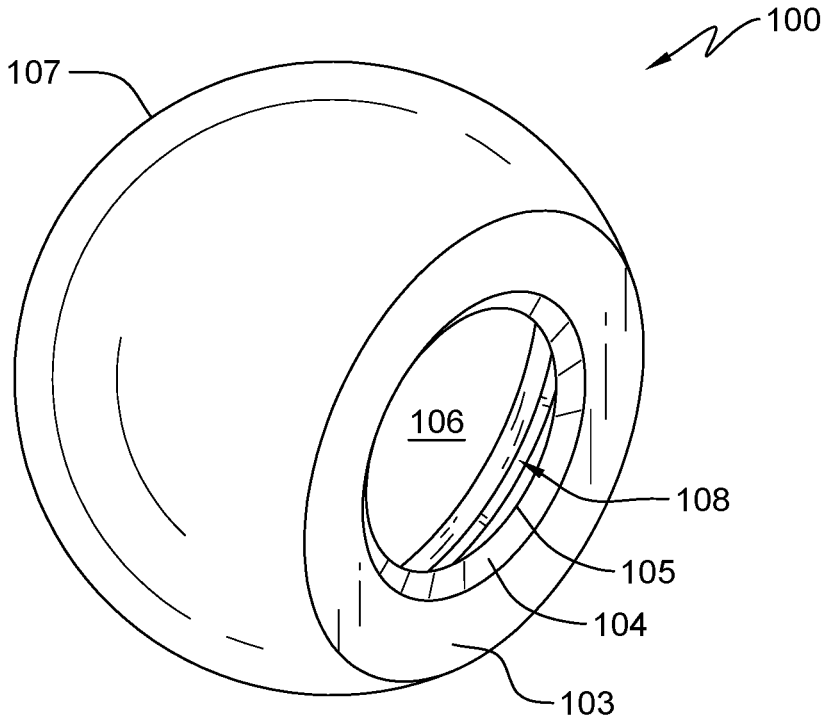
FIG. 1 depicts an isometric view of an exercise device, in accordance with one embodiment of the present invention.

The present invention is a substantially spherical apparatus with a flattened portion and a cavity placed on the flattened portion. Based on this design, the present invention provides an advantage over previously designed exercise balls, specifically related to yoga where the exercised device remains stationary in one position when placed on the flattened side, but has the opportunity to be used on the convex portion to create the instability of a normal exercise ball. Based on the cavity design, the exercise balls are easily stackable and are secure in the stacked position. The cavity is also contoured in a way to provide a lip where a user would be able to grasp the lip of the cavity to use the exercise ball for specific workouts and/or exercises. The present invention provides the advantages of improving one's posture through the strengthening and stretching of the muscles surrounding the lower portion of one's spine and buttocks. This strengthening and stretching of the muscles is further improved by the use of a ball (yoga ball) to target the muscles near the sacrum, coccyx, ilium, pubis, and ischium (hip bone), where the raised and curved features of the ball provide additional stretching of these muscles, and the stability of the present invention allows for the person to concentrate on the stretching.

As will be apparent to those of skill in the art upon reading this disclosure, each of the individual embodiments described and illustrated herein has discrete components and features which may be readily separated from or combined with the features of any of the other several embodiments without departing from the scope or spirit of the present invention. It is to be understood that this invention is not limited to particular embodiments described, as such may, of course, vary. It is also to be understood that the terminology used herein is for the purpose of describing particular embodiments only, and is not intended to be limiting, since the scope of the present invention will be limited only by the appended claims.

Unless defined otherwise, all technical and scientific terms used herein have the same meaning as commonly understood by one of ordinary skill in the art to which this invention belongs. Although any methods and materials similar or equivalent to those described herein can also be used in the practice or testing of the present invention, the preferred methods and materials are now described.

All publications and patents cited in this specification are herein incorporated by reference as if each individual publication or patent were specifically and individually indicated to be incorporated by reference and are incorporated herein by reference to disclose and describe the methods and/or materials in connection with which the publications are cited. The citation of any publication is for its disclosure prior to the filing date and should not be construed as an admission that the present invention is not entitled to antedate such publication by virtue of prior invention. Further, the dates of publication provided may be different from the actual publication dates which may need to be independently confirmed.

It must be noted that as used herein and in the appended claims, the singular forms "a", "an", and "the" include plural referents unless the context clearly dictates otherwise. It is further noted that the claims may be drafted to exclude any optional element. As such, this statement is intended to serve as antecedent basis for use of such exclusive terminology as "solely," "only" and the like in connection with the recitation of claim elements or use of a "negative" limitation.

Figure 2:
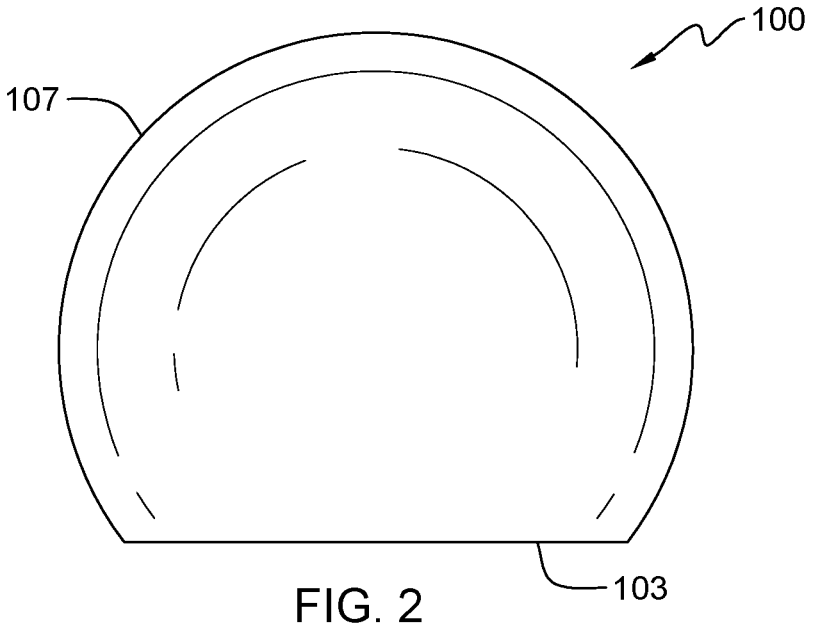
FIG. 2 depicts a section view of the exercise device, in accordance with one embodiment of the present invention.

FIGS. 1 and 2 depict views of the exercise device 100, in accordance with one embodiment of the present invention. The exercise device 100 is comprised of a substantially convexed area 102 and a flattened bottom 103. In some embodiments the convexed area 102 is oval or various shapes and is not limited to just a spherical shape. The user may use the exercise device 100 when performing various exercises to improve the user's core strength and balance, as well as use the exercise device in a stable position for workouts or exercises that require the use of a ball but not require instability element or difficulty. The exercise device 100 is somewhat malleable so that the exercise device 100 at least slightly deforms when a force is applied thereto. The exercise device may be constructed from various types of foam or materials common to exercise balls or rollers known to one skilled in the art. The material may be chosen based on the desired deflection or rigidity of the exercise device.

The portion of the exercise device 100 that is identified as the flattened bottom 103 is based on the degree of stability which is desired and the overall diameter of the exercise device. If the flattened bottom 103 has a larger surface area the exercise device 100 is likely to have increased stability, and if the surface area of the flattened bottom 103 is decreased the stability will decrease. In the depicted embodiment, the flattened bottom 103 is ten percent (10%) of the surface area of the exercise device 100. By decreasing the area of the flattened bottom 103, the instability of the exercise device increases. The flattened bottom 103. Accessible through the flattened bottom 103 of the exercise device 100 is a recess 104. The recess 104 has a lip 105 which leads into a cavity 106. The recess 104 is sized to receive at least a portion of another exercise device 100 so that the devices 100 can be easily and securely stacked one on top of the other. In some embodiments, the exercise device may have additional cavities 106, these additional cavities 106 may be completely contained within the exercise device 100 and are not accessible, but affect the deflection and movement of the exercise device 100 when the user interacts with the device. The additional cavities may also assist in decreasing the overall weight of the exercise device 100.

The recess 104 has a concave design of a diameter substantially similar to or greater than that of the exercise device 100 so that when stacked, the exercise devices 100 fit securely together. The lip 105 provides for a section of the exercise device, that when performing specific workouts where the user needs to use the exercised device 100 as a base, but may need additional support, the lip 105 can be firmly grasped by the user to hold onto, and firmly press themselves against the exercise device 100. The lip 105 may have various contours or designs based on the intended exercises to be performed. The cavity 106, assist with creating the design and contour of the lip 105 and also providing for the additional space for stacking the exercise devices 100. The cavity 106 is sized and shaped to assist with the stacking of the devices 100, but to not interfere with the overall structural integrity of the exercise devices 100. If the cavity is oversized, the exercise device 100 may flex or morph beyond the desired amount, and if the cavity is undersized, the lip 105 may not provide enough surface area or contour to be easily grasped by the user.

The lip 105 may have a variety of designs to assist the user in firmly grasping the device 100, through alterations and modification to the lip 105 and the distal surface of the cavity 106, additional cutouts and other additional features. In the depicted embodiment, one of the exercise devices 100 has a protrusion 108 within the cavity 106 which provides an additional component which the user is able to grab onto when using the device.

In the depicted embodiment, the surface 107 of the exercise device 100 is smooth. In a number of embodiments, the surface 107 may have a variety of textures, patterns, or designs for both functionality and aesthetics. The surface texture may be to create some friction between the user and the device 100 so they are less likely to slip off.

Figure 3:
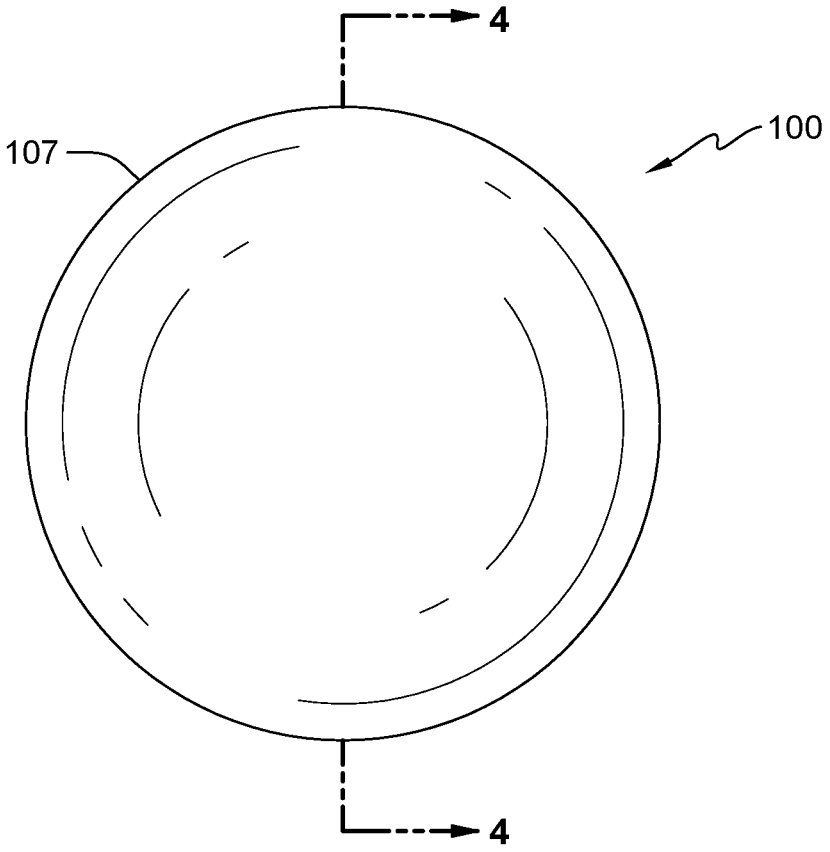
FIG. 3 depicts an isometric view of the exercise devices stacks, in accordance with one embodiment of the present invention.
Figure 4:
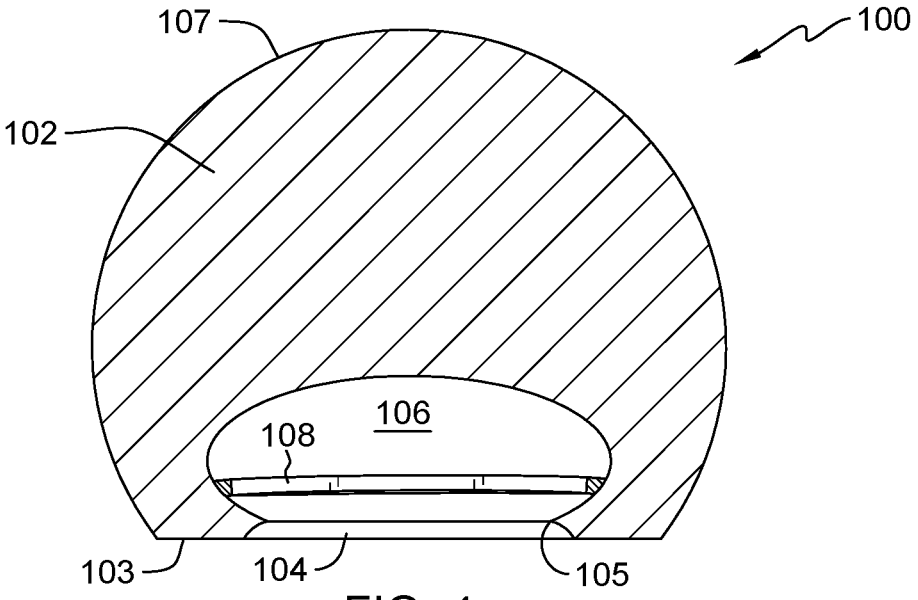
FIG. 4 depicts an image of the exercise device in use, in accordance with one embodiment of the present invention.

FIGS. 3 and 4 depict various manners in which the exercise device 100 may be used, in accordance with an embodiment of the present invention. In the first orientation, the flat bottom 103 is situated against the ground to provide additional stability for the person performing the exercise. In the second orientation, the person is using the lip 105 to grasp the device 100 and to keep the device 100 in the desired position throughout the exercise. FIG. 4 may depict, for example, a cross section of the exercise device 100 across section line 4-4 shown in FIG. 3.

Figure 5:
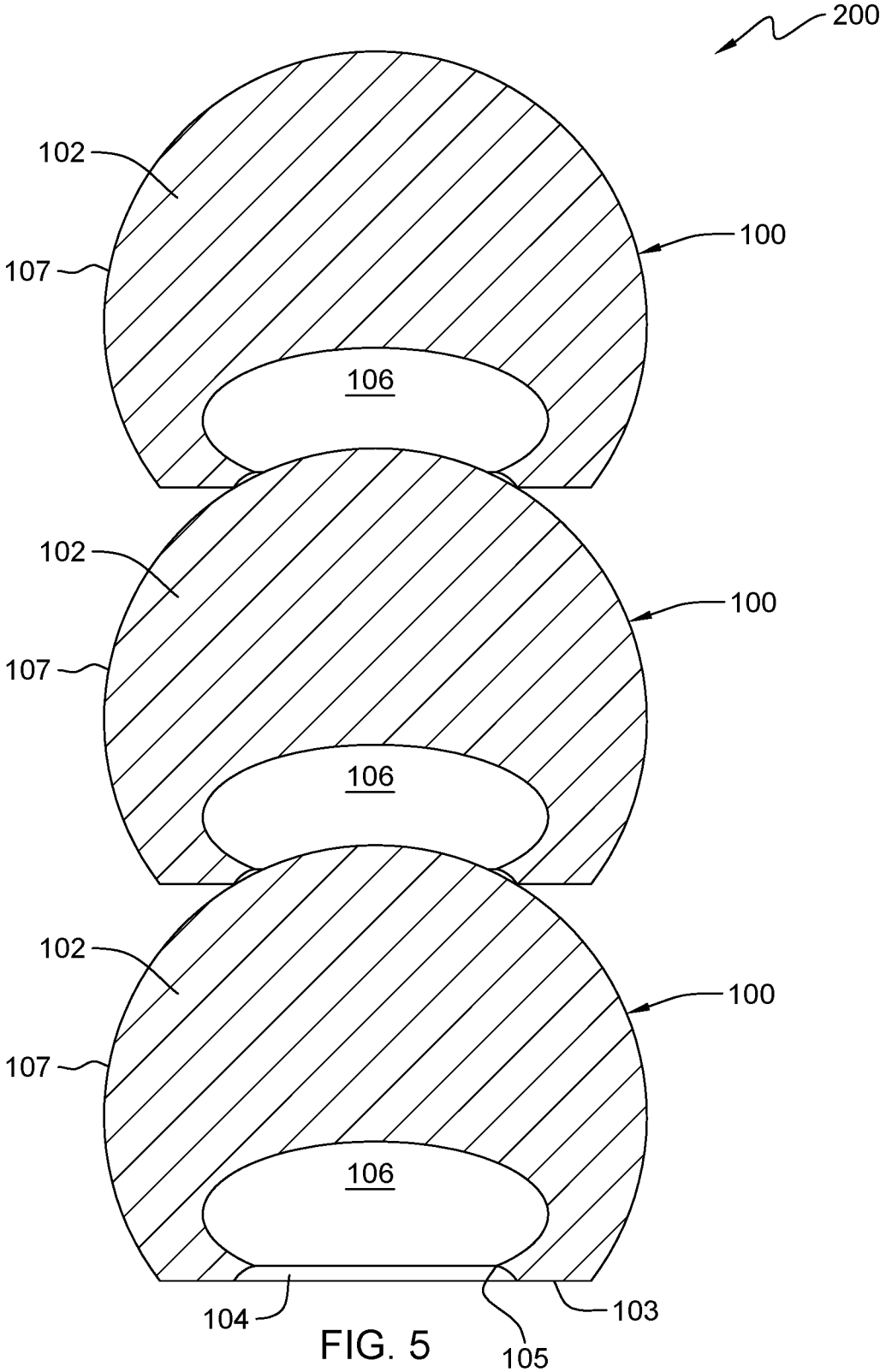
FIG. 5 depicts an image of the exercise device in use, in accordance with one embodiment of the present invention.

FIG. 5 depicts a series 200 of the exercise devices 100 stacked on one another, in accordance with an embodiment of the present invention. The recess 104 and the contour of the lip 105 is the same curvature as the convexed area 102 of the exercised device 100. This allows the exercise devices 100 to be stacked and stable. In some embodiments, the lip 105 has a coating to increase the friction between the exercise device 100.

While this invention has been described in conjunction with the specific embodiments outlined above, it is evident that many alternatives, modifications and variations will be apparent to those skilled in the art. Accordingly, the preferred embodiments of the invention, as set forth above, are intended to be illustrative, not limiting. Various changes may be made without departing from the spirit and scope of this invention.

What is claimed is:

1. An exercise device comprising:

a convex member having a substantially flat portion, wherein a cavity is accessible from the substantially flat portion through a recess, wherein a lip is formed between the recess and the cavity, wherein the recess has a rounded concave surface configured to butt against a second convex member over an entirety of the rounded concave surface.

2. The exercise device of claim 1, wherein the convex member of the exercise device has a texture.

3. The exercise device of claim 1, wherein the substantially flat portion is a predetermined area, wherein the predetermined area is relative to the surface area of the convex member.

4. The exercise device of claim 1, wherein the lip has a predetermined contour.

5. The exercise device of claim 1, wherein the lip has a predetermined internal diameter.

6. The exercise device of claim 1, wherein the cavity is sized relative to an internal diameter of the lip.

7. The exercise device of claim 1, wherein the cavity has a substantially non-circular ellipsoidal shape when undeformed.

8. An exercise device comprising:

a convex member, wherein a portion of the convex member is substantially flat permitting access to an internal cavity via an opening of the internal cavity, the opening having a recess, wherein the recess has a rounded concave surface configured to butt against a second convex member over an entirety of the rounded concave surface; and a lip having a predetermined contour formed proximate the opening.

9. The exercise device of claim 8, wherein the internal cavity has a predetermined shape and volume.

10. The exercise device of claim 8, wherein the lip has a predetermined internal diameter.

11. The exercise device of claim 8, wherein the internal cavity is sized relative to an internal diameter of the lip.

12. The exercise device of claim 8, wherein a protrusion is present around the lip of the internal cavity.

13. An exercise device comprising a convex member with a substantially flat portion, wherein a cavity is disposed on the flat portion and accessible via an opening and the opening has a recess, wherein the recess has a rounded concave surface configured to butt against a second convex member over an entirety of the rounded concave surface to facilitate stacking of the exercise device.

14. The exercise device of claim 13, wherein the cavity has a plurality of protrusions positioned distal to the lip.

15. The exercise device of claim 13, wherein an exterior surface of the convex member has a rubberized coating.

* * * * *